US012324547B2

(12) United States Patent
Ortiz

(10) Patent No.: US 12,324,547 B2
(45) Date of Patent: Jun. 10, 2025

(54) TOILET AEROSOL CONTAINMENT DEVICE

(71) Applicant: Peter Ortiz, Atlantic City, NJ (US)

(72) Inventor: Peter Ortiz, Atlantic City, NJ (US)

( * ) Notice: Subject to any disclaimer, the term of this patent is extended or adjusted under 35 U.S.C. 154(b) by 173 days.

(21) Appl. No.: 18/463,373

(22) Filed: Sep. 8, 2023

(65) Prior Publication Data

US 2024/0164598 A1 May 23, 2024

(51) Int. Cl.
*A47K 13/24* (2006.01)

(52) U.S. Cl.
CPC ..... *A47K 13/247* (2013.01)

(58) Field of Classification Search
CPC ..... A47K 13/247
USPC ..... 4/237, 238, 485, 234, 98, 217
See application file for complete search history.

(56) References Cited

U.S. PATENT DOCUMENTS 2,309,885 A * 2/1943 Carman ..... E03D 9/052 219/217
2,332,111 A 10/1943 Porter et al.
3,193,845 A * 7/1965 Funk ..... E03D 9/00 4/300.3
3,386,106 A 6/1968 Clemens
3,523,309 A * 8/1970 Munden ..... E03D 9/052 4/213
3,927,429 A * 12/1975 Pearson ..... E03D 9/04 4/213
4,317,242 A * 3/1982 Stamper ..... E03D 9/052 4/213
4,348,776 A * 9/1982 Sarjeant ..... A47K 13/10 4/300.3
4,836,232 A 6/1989 De Rosa et al.
4,861,090 A 8/1989 Gavrieli
5,276,925 A * 1/1994 Blaha ..... E03D 11/025 4/300.3
5,373,589 A * 12/1994 Rego ..... E03D 9/00 4/300.3
5,564,135 A * 10/1996 Jones ..... E03D 9/00 4/300.3
5,655,233 A * 8/1997 Lackey, Jr. ..... A47K 13/14 4/234
D384,139 S * 9/1997 Tribolet ..... D23/311
5,815,851 A * 10/1998 Perry ..... A47K 13/24 4/300.3
5,967,161 A 10/1999 Neal
(Continued)

FOREIGN PATENT DOCUMENTS

EP 3903656 A1 * 11/2021 ..... A47K 13/307
FR 3082719 A1 * 12/2019 ..... A47K 13/08

*Primary Examiner* — Lori L Baker
(74) *Attorney, Agent, or Firm* — Michael J. Feigin, Esq.; Feigin and Fridman LLC

(57) ABSTRACT

A fan structure comprising a plurality of abutting blades is attached to a compressible spring that is between a toilet seat and a toilet body. The fan structure has a first resting configuration, wherein the fan structure and blades are unfurled to cover a toilet portal, thereby trapping in odors. When pressure is applied to the toilet seat from a user sitting thereupon, the compressible spring contracts and the fan structure retracts to underneath the toilet seat, exposing the toilet portal for use in a second activated configuration. Cessation of compression allows the spring to expand and the fan structure to re-assume the first resting configuration.

19 Claims, 6 Drawing Sheets

(56) References Cited

U.S. PATENT DOCUMENTS

| | | | | |
|---|---|---|---|---|
| 6,000,070 | A * | 12/1999 | Bonin | E03D 11/08 4/252.3 |
| 6,526,598 | B1 * | 3/2003 | Black | F03G 1/022 4/217 |
| 6,550,075 | B1 * | 4/2003 | Brannon, III | E03D 9/00 4/300.3 |
| 6,851,131 | B1 | 2/2005 | Adams | |
| 6,905,177 | B1 | 6/2005 | Murillo | |
| 6,978,491 | B1 * | 12/2005 | Miller | E03D 11/025 4/300.3 |
| D552,756 | S | 10/2007 | Tsang | |
| 7,412,732 | B1 * | 8/2008 | Leonard | E03D 9/00 4/300.3 |
| 7,644,451 | B1 | 1/2010 | Ross | |
| 7,976,600 | B1 * | 7/2011 | Safuto | A47K 13/24 4/371 |
| 8,136,568 | B2 | 3/2012 | DeBauche | |
| 10,494,802 | B1 * | 12/2019 | Kolesar | E03D 9/00 |
| 11,568,994 | B2 | 1/2023 | Glover, Sr. | |
| 11,622,658 | B1 * | 4/2023 | Rodriguez | A47K 13/08 4/300.3 |
| D985,105 | S | 5/2023 | Gutierrez | |
| 11,685,594 | B2 * | 6/2023 | Sylvia | A61M 3/0233 4/229 |
| 2009/0320198 | A1 * | 12/2009 | Yefremov | A47K 13/24 4/300.3 |
| 2015/0191903 | A1 * | 7/2015 | Doerscher, Sr. | E03D 11/16 4/252.6 |
| 2015/0192393 | A1 | 7/2015 | Yakoub | |
| 2015/0238058 | A1 * | 8/2015 | Couch | E03D 9/00 4/300.3 |
| 2022/0279993 | A1 * | 9/2022 | Woon | A47K 13/105 |
| 2023/0062329 | A1 * | 3/2023 | Mathur | A47K 13/305 |

* cited by examiner

TOILET AEROSOL CONTAINMENT DEVICE

FIELD OF THE INVENTION

The present invention relates to toilet portal covers and, more specifically, to a technology that allows for the weight of a user to open or close a collapsible cover.

BACKGROUND

Toilets are a critical device when it comes to human waste management, creating easily accessible areas for its release and disposal. However, the smell of human waste is often strongly unpleasant. When left undealt with, odors can permeate into the air of restrooms, and residential and commercial environments. In addition to discomfort, this can also pose health risks.

In order to deal with this problem, a few conventional solutions have been employed. One such solution is the toilet lid, which can be hingedly raised and lowered. When lowered, the toilet lid covers the toilet portal, thereby mitigating outwards airflow. However, a toilet lid is not airtight, and thus cannot fully resolve the issue of smell. Furthermore, since the toilet lid must be open for urinating in the toilet and closing the lid provides no operational advantage when it comes to waste depositing, most users of the toilet are unlikely to close the toilet lid after each use. Especially in highly trafficked restrooms where sanitary conditions are not optimal, patrons of restrooms often attempt to avoid touching surfaces as much as possible. Thus, the toilet lid is not enough of a present barrier to fully mitigate odors.

Toilet deodorizers and sprays have also been employed to eliminate toilet bowl smells. Similarly to the toilet lid, however, many users of toilets are unlikely to spray deodorizers after each usage of the toilet. This may be due to the hurried nature in which users utilize bathroom facilities, or the costly nature of continuously purchasing toilet deodorizer that, when used perhaps dozens of times daily, must be frequently replaced.

Therefore, there is a need for technology that automatically provides a barrier to toilet odors, while not necessitating user involvement beyond the already established steps of using a toilet.

SUMMARY OF THE DISCLOSED TECHNOLOGY

A toilet aerosol containment device has a compressible spring assembly to which a compressible spring and a fan structure are attached. The fan structure is typically positioned in a first configuration (also known as a resting configuration), in which the fan structure is unfurled and calibrated to cover a toilet portal. This first/resting configuration is maintained whilst the compressible spring is in an expanded condition—i.e. the spring is not being compressed. When compressional forces are applied to the spring, either from a user sitting on a toilet seat to whose underside the flat-sided cover is attached or otherwise, the spring contracts. This contraction, either alone or with another mechanism, causes the fan structure to assume a second (or activated) configuration, in which the fan structure is inwardly collapsed and calibrated to fit entirely underneath a toilet seat, thereby exposing the toilet portal. Thus, applying compression to the compressible spring or simply by sitting on the toilet seat, a user of the device exposes the toilet portal for use. Upon the cessation of the compression or simply by the user standing up from the toilet seat, the device covers the toilet portal, thereby reducing odor and fumes therefrom that can permeate into the surrounding air.

While the fan structure is inwardly collapsing from the first/resting to the second/activated configuration, the fan structure may assume a transitory configuration. Similarly, the fan structure may assume the transitory configuration as an intermediary configuration while unfurling from the second/activated configuration to the first/resting configuration. While in the transitory configuration, a portion of the toilet bowl is covered.

The fan structure may have a plurality of blades, wherein each blade is attached to a same vertical extent of the compressible spring. While the fan structure is in the second/activated configuration or the transitory configuration, a portion of each blade may overlap a portion of an adjacent blade. Turning to a specific shape of each blade in an embodiment of the disclosed technology, each blade has three curvilinear edges. The first and second endpoints of a first curvilinear edge are endpoints of a second and third curvilinear edge respectively. The second and third curvilinear edges meet at an apex of the shape, such that the apex is opposite the first curvilinear edge. This apex may be the point of each blade which is fixedly connected to the same vertical extent of the compressible spring.

While the toilet aerosol containment device is in the first/resting configuration, an entirety of the second curvilinear edge of every said blade of said plurality of said blades, except one, may abut an entirety of the third curvilinear edge of an adjacent blade. Similarly, an entirety of the third curvilinear edge of every said blade of said plurality of said blades, except one, may abut an entirety of the second curvilinear edge of an adjacent blade. The two blades excluded are blades which, unlike the other blades, only abut one blade instead of two. These blades are the end, outermost blades of the fan structure.

At least one said endpoint of the first curvilinear edge of each blade may abut an endpoint of the first curvilinear edge of an adjacent blade, such that every first curvilinear edge of the blades forms a contiguous curvilinear edge, which comprises part of a continuous curvilinear edge of the fan structure.

The disclosed technology further discloses a method of installing a toilet aerosol containment device. The steps of the method include attaching a face of a flat-sided cover to a compressible spring, which is bistable between an expanded configuration and a compressed configuration; attaching a fan structure to the compressible spring, such that the fan structure is in a first configuration, which is unfurled and configured to cover a toilet portal, when the spring is in the expanded configuration; and attaching the fan structure to the compressible spring, such that the fan structure assumes a second configuration when the compressible spring is in a compressed condition, such that the fan structure is inwardly collapsed and calibrated to fit underneath a toilet seat, thereby exposing the toilet portal.

Further steps of the method of installment may include attaching a plurality of fan blades to a same vertical extent of the compressible spring, in order to form the fan structure. Another step may be attaching the fan structure to the compressible spring, such that the fan structure assumes the previously described transitory configuration whilst inwardly collapsing from the first configuration to the second configuration or whilst unfurling from the second configuration to the first configuration.

The method of installing the toilet aerosol containment device may use blades of a shape as previously described that overlap in the second and transitory configurations as previously described. A step may comprise positioning each blade such that edges of each blade abut one another while the fan structure is in the first configuration, as previously described.

A further step may be securing the flat-sided cover to the underside of a toilet seat, which is hingedly connected to a toilet body (within which the toilet portal is located), such that compression applied to the toilet seat compresses the compressible spring between the flat-sided cover and the toilet body, as previously described. The compression and cessation thereof affect the configurations of the fan structure as previously described.

DETAILED DESCRIPTION OF EMBODIMENTS OF THE DISCLOSED TECHNOLOGY

The present technology comprises a toilet aerosol containment device. In a first resting configuration, a fan structure of the device is extended over a toilet portal in order to mitigate odors emanating therefrom. When a user sits upon a toilet seat, however, a compressible spring assumes a compressed condition, which causes blades of the fan to fold into an orientation such that said blades are substantially underneath the toilet seat and the toilet portal is exposed for use. When the posterior of a person is removed from the toilet seat, the spring reassumes an expanded condition, whereupon the fan covers the toilet portal.

Embodiments of the disclosed technology will become more clear in view of the following description of the figures.

Figure 1A:
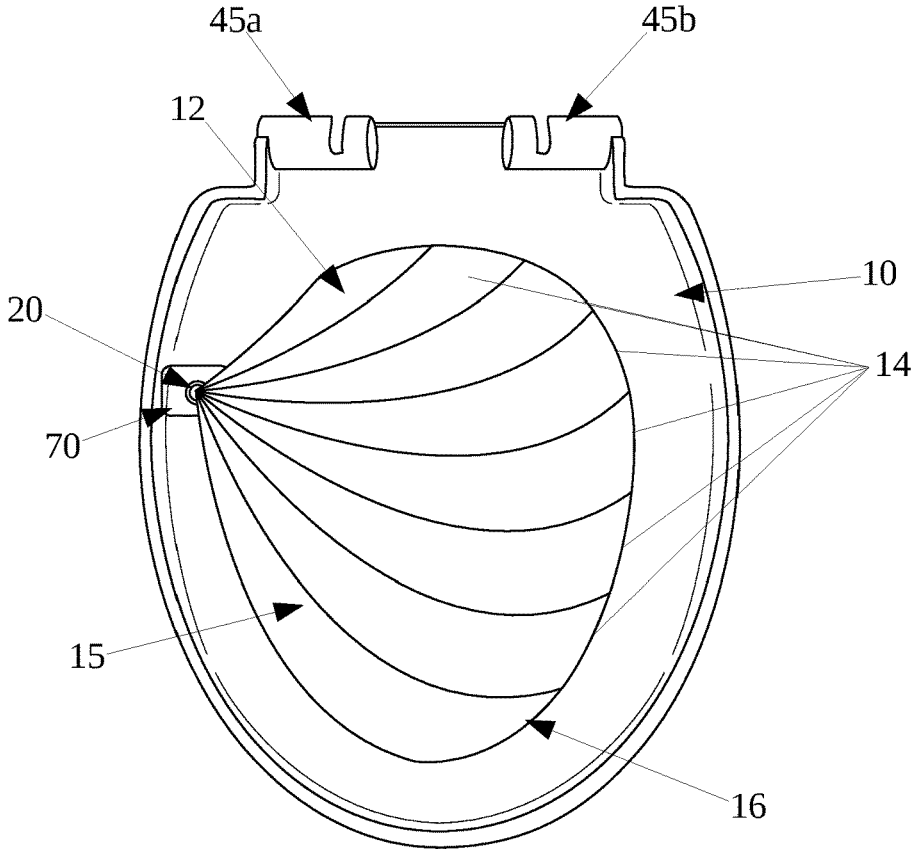
FIG. 1A is a bottom plan view of the toilet aerosol containment device with the fan structure fully extended over the portal in a resting configuration in an embodiment of the disclosed technology.
Figure 2:
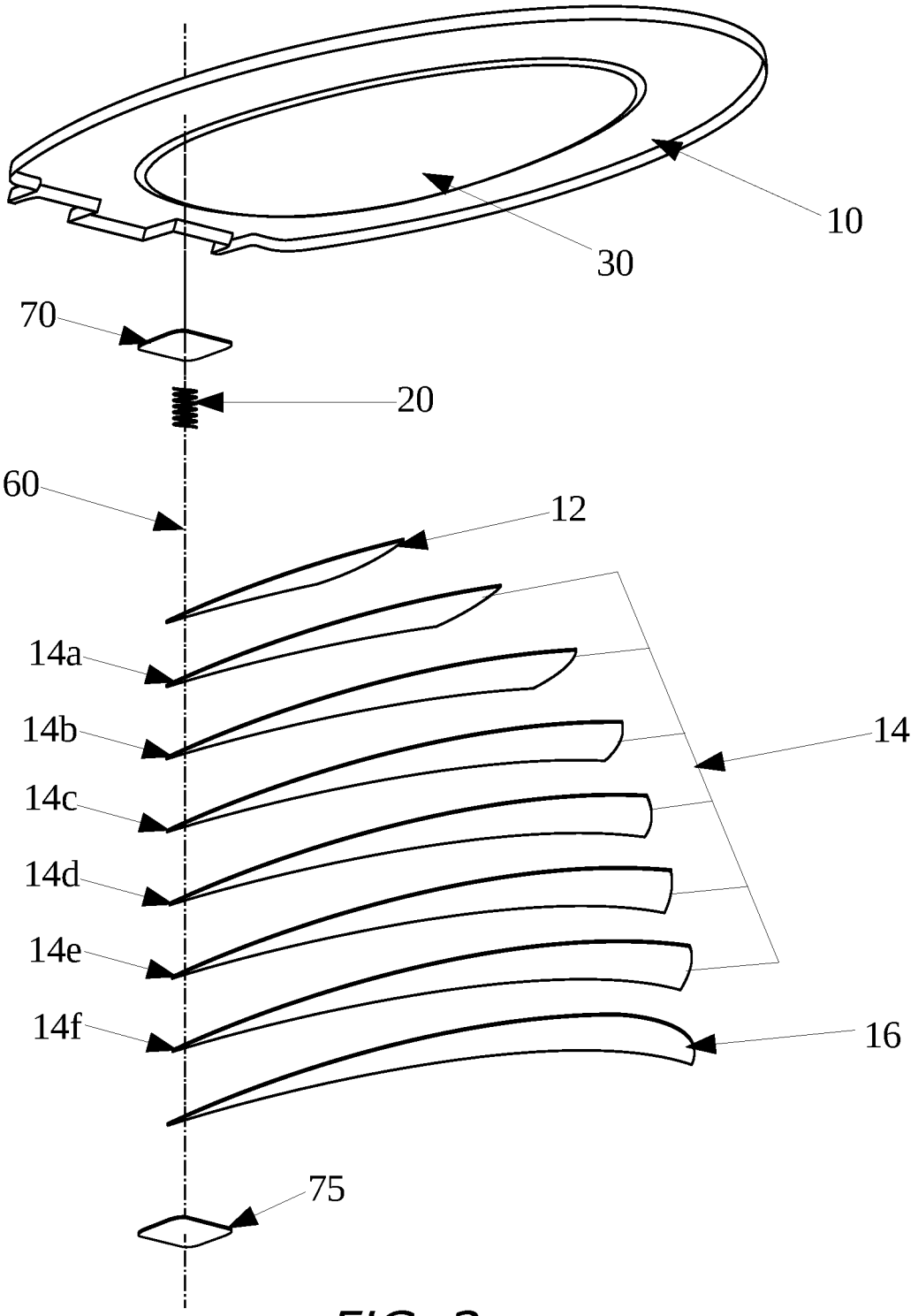
FIG. 2 is an exploded view of the components of the toilet aerosol containment device in an embodiment of the disclosed technology.

Skipping first to FIG. 2, FIG. 2 is an exploded view of components of the toilet aerosol containment device in an embodiment of the disclosed technology. Individual blades 12, 14, (comprising interior blades 14*a*-14*f*), and 16 are attached to a compressible spring 20 along a same vertical extent 60 thereof. The same vertical extent 60 may be substantially linear and perpendicular to the ground. A top end of the compressible spring 20 is attached to a first flat-sided cover 70 in some embodiments. Furthermore, a bottom end of the compressible spring 20 may be attached to a second flat-sided cover 75. A majority of a side of the flat-sided cover that is opposite and parallel to the side which said compressible spring 20 is attached to abuts the bottom of a toilet seat 10, said toilet seat comprising a toilet portal 30, in some embodiments. (Note that the term "toilet portal" refers to both the area encircled by the toilet seat 10 as well as the area thereunder within a toilet 40 (see FIG. 3) when said toilet aerosol containment device is affixed thereto). Thus, the toilet seat 10 is connected to the flat-sided cover which is connected to the compressible spring 20 which has a same vertical extent 60 to which every blade is attached. The individual blades form part of a fan structure 15, which, in addition to the compressible spring 20 and the toilet seat 10, is shown in FIG. 1A.

FIG. 1A is a bottom plan view of the toilet aerosol containment device with the fan structure 15 in a resting configuration in an embodiment of the disclosed technology. The fan structure 15 is comprised of individual blades 12, 14*a*-14*f*, and 16. (Further description of the structure of the blades can be found in the pursuant description of FIG. 5).

Figure 3A:
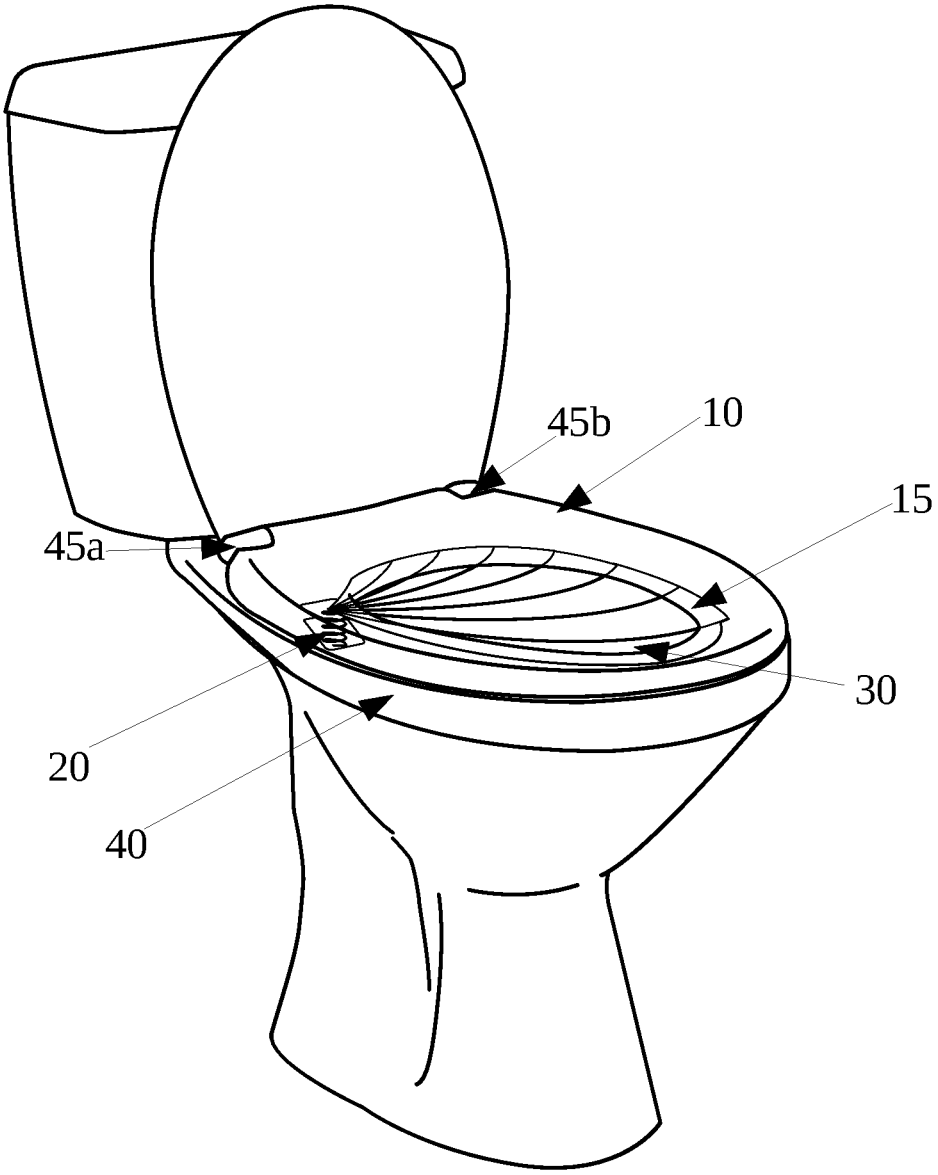
FIG. 3A is a top side perspective view of the toilet aerosol containment device secured to a toilet with the fan structure fully extended over the portal in a resting configuration in an embodiment of the disclosed technology.
Figure 3B:
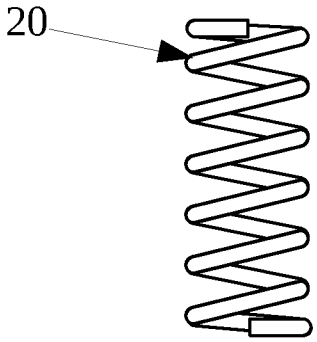
FIG. 3B is a front elevation view of the spring in an uncompressed configuration in an embodiment of the disclosed technology.

FIG. 3A is a top side perspective view of the toilet aerosol containment device hingedly connected by rounded protrusions 45*a* and 45*b* to a toilet 40 with the fan structure 15 fully extended over the portal 30 in a resting configuration in an embodiment of the disclosed technology. Covering the toilet portal is advantageous in that a physical barrier is provided between the interior of the toilet 40 in which human waste is deposited and the surrounding environs. Thus, the permeation of said odors into the air and overall surroundings is mitigated. Furthermore, the extended fan structure 15 serves as a visual barrier, obstructing the view into the toilet and any remaining waste residues therein. The resting configuration is the default configuration of the fan structure 15 in which the fan structure is oriented. In the resting configuration, the compressible spring 20 is in an expanded condition, as shown in FIG. 3B. (Note that the toilet seat 10 is depicted as transparent for the purposes of making visible the location of the compressible spring 20, which is in fact underneath the toilet seat 10).

FIG. 3B is a front elevation view of the spring in an uncompressed configuration in an embodiment of the disclosed technology. Said expanded condition is the default condition of the compressible spring 20. However, a second configuration that exposes the toilet portal 30 can be assumed.

Figure 4A:
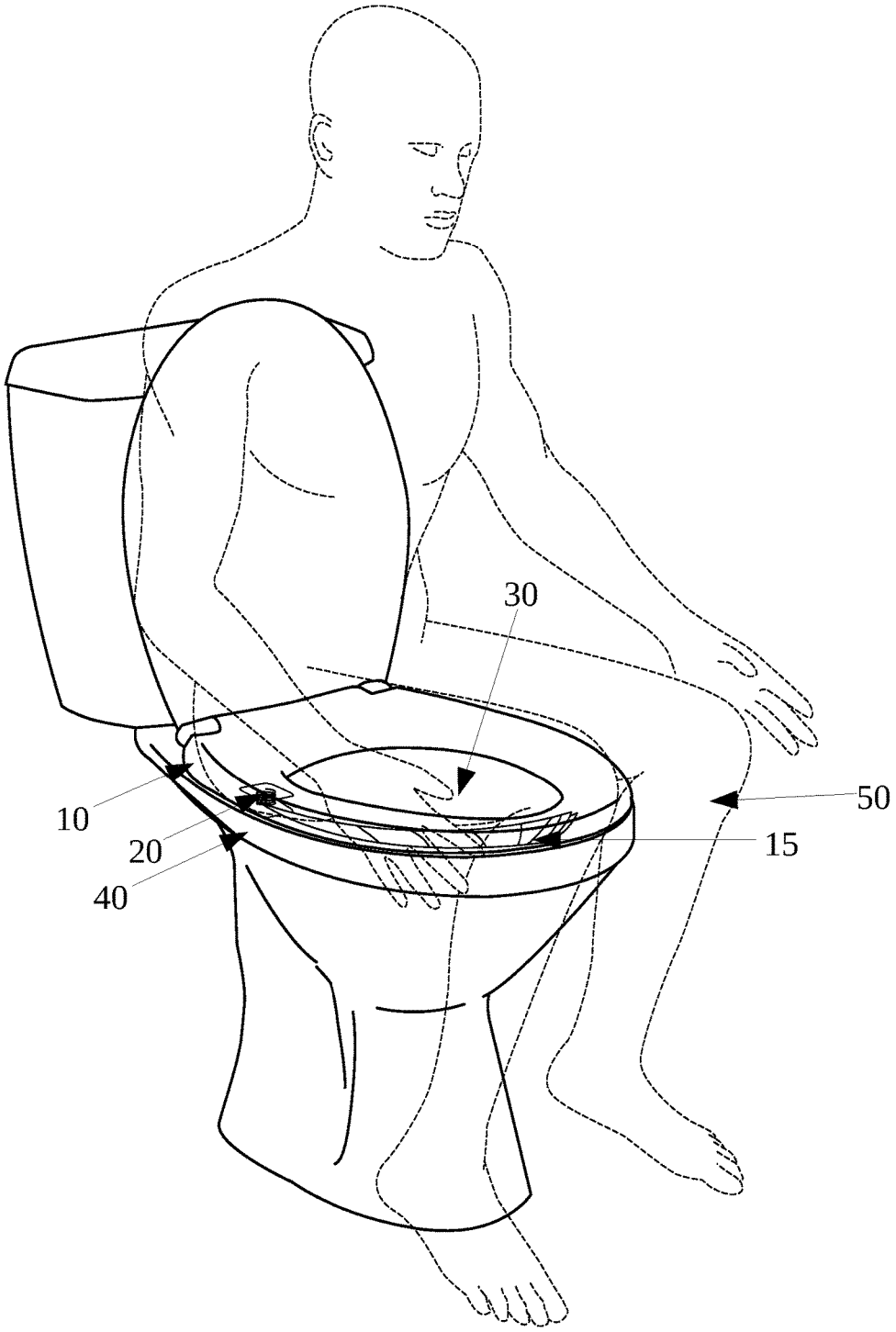
FIG. 4A is a top side perspective view of the toilet aerosol containment device secured to the toilet with the fan fully retracted and folded over itself in an embodiment of the disclosed technology. A silhouette of a person sitting on the toilet seat is shown in dotted lines.

FIG. 4A is a top side perspective view of the toilet aerosol containment device secured to the toilet 40 with the fan structure 15 fully retracted and folded over itself in an embodiment of the disclosed technology, thereby exposing the toilet portal 30. A silhouette of a person 50 sitting on the toilet seat 10 is shown in dotted lines. The fan structure 15 is oriented with relation to the toilet 40 and toilet seat 10 such that said fan structure 15 is retractable. The weight of the user 50 resting on the toilet seat 10 (when the toilet seat 10 is oriented in a typical manner in which toilet users sit thereupon) acts upon the toilet seat 10, which in turn compresses the compressible spring 20 between the toilet seat 10 and the toilet 40 into a compressed condition.

Figure 4B:
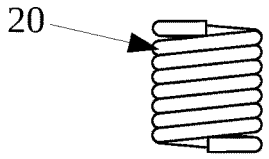
FIG. 4B is a front elevation view of the spring in a compressed configuration in an embodiment of the disclosed technology.

FIG. 4B is a front elevation view of the spring 20 in a compressed configuration in an embodiment of the disclosed technology.

Now returning to FIG. 1C, FIG. 1C is a bottom plan view of the toilet aerosol containment device with the fan structure fully retracted and folded over itself in an activated configuration in an embodiment of the disclosed technology. The blades 12, 14*a*-14*f*, and 16 of the fan structure (as shown in FIG. 2) inwardly telescope/retract, such that the majority of the surface area of each blade is substantially located in planes that are parallel to other planes wherein a substantial majority of the surface area of another blade or blades substantially lies. Described differently, each blade of the blades 12, 14*a*-14*f*, and 16 overlaps or is overlapped by a majority of another blade in the xz plane, said plane being substantially parallel to the ground. In this configuration, the blades are substantially entirely located beneath the toilet seat 10, thereby exposing said toilet portal 30 for use.

The compressible spring 20 is resiliently compressible and expandable. Thus, when a user 50 (see FIG. 4A) of the toilet 40 removes the weight of said user 50 from upon the toilet seat 10, the compressible spring 20 expands, whereupon the fan structure 15 reassumes the default resting configuration, in which the toilet portal 30 is covered. While the fan structure 15 transitions between the first/resting configuration and the second/activated configuration or vice versa, the fan structure may assume a transitory configuration as shown in FIG. 1B.

Figure 1B:
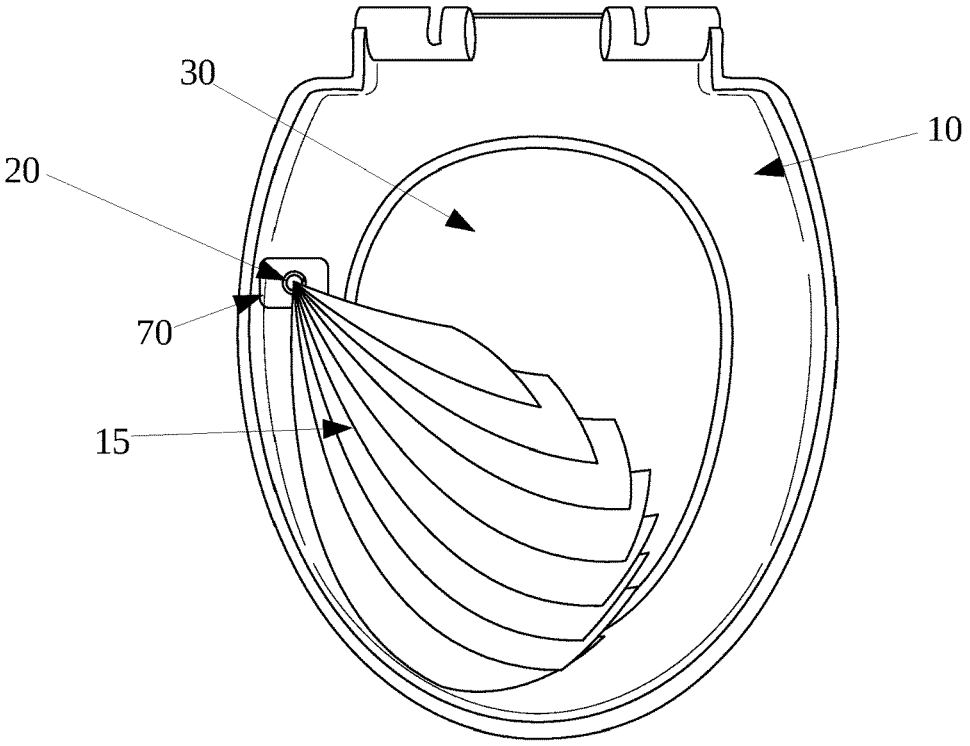
FIG. 1B is a bottom plan view of the toilet aerosol containment device with the fan structure partially extended over the portal in a transitory configuration in an embodiment of the disclosed technology.
Figure 1C:
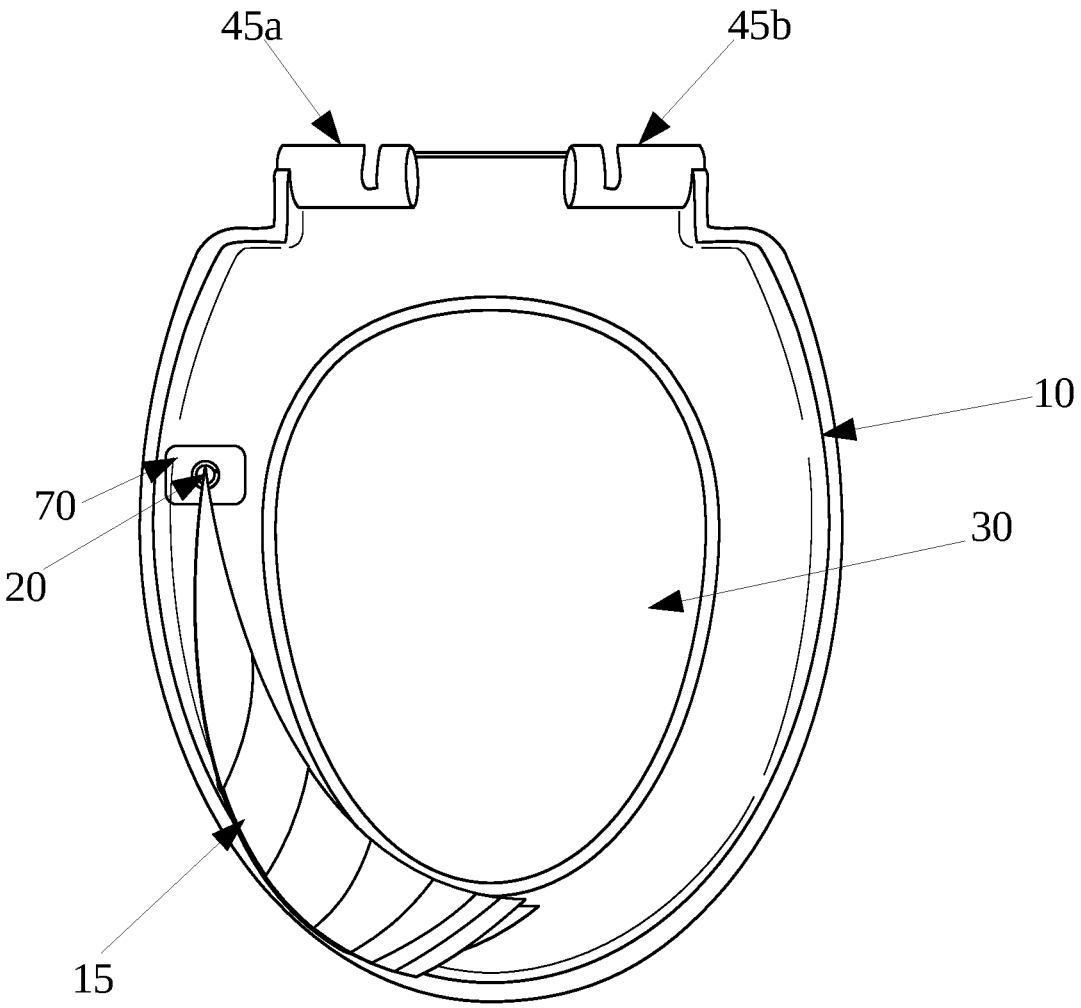
FIG. 1C is a bottom plan view of the toilet aerosol containment device with the fan structure fully retracted and folded over itself in an activated configuration in an embodiment of the disclosed technology.

FIG. 1B is a bottom plan view of the toilet aerosol containment device with the fan structure partially extended over the portal in a transitory configuration in an embodiment of the disclosed technology. In the transitory configuration, the compressible spring is somewhat compressed, but not as fully compressed as in FIG. 4B. The fan structure 15 is somewhat inwardly collapsed, such that the fan blades 12, 14*a*-14*f*, and 16 overlap somewhat in the xz plane. A portion of the toilet portal 30 is exposed and a portion thereof is covered. The fan structure 15 is partially under the toilet seat 10.

Figure 5:
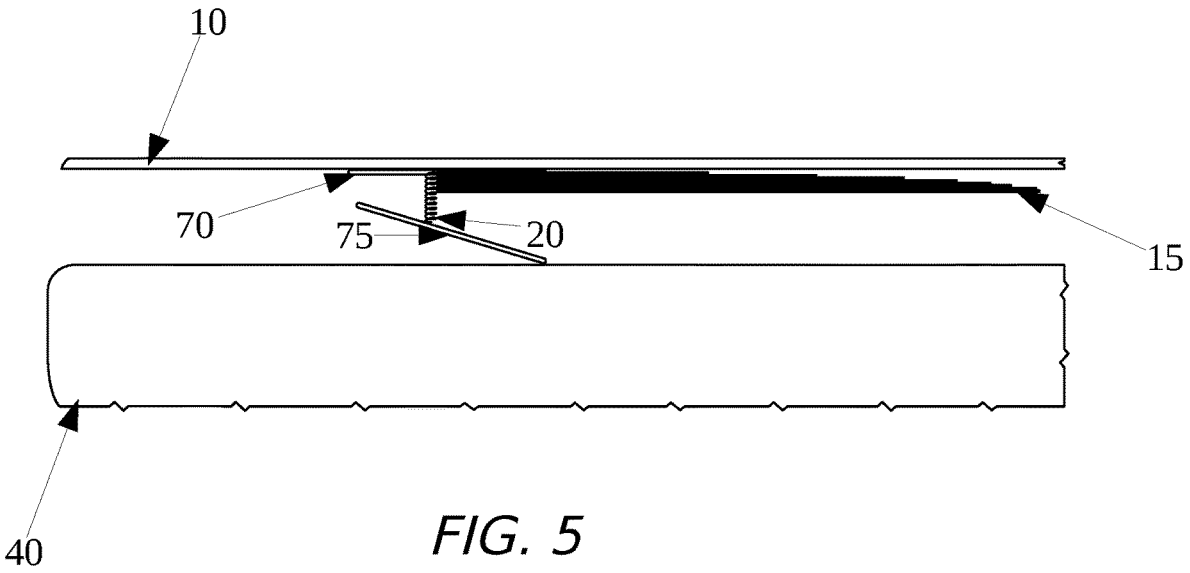
FIG. 5 is a side elevation view of the toilet aerosol containment device.

FIG. 5 is a side elevation view of the toilet aerosol containment device. Compressible spring 20 is shown in an expanded condition and fan structure 15 is shown in a resting configuration. Compressible spring 20 is attached to a flat-sided cover 70. The face of the flat-sided cover 70 opposite the face thereof which is attached to the compressible spring 20 is abutted along the bottom of the toilet seat 10. Downwards compressional forces applied to the toilet seat 10 press down the flat-sided cover and the compressible spring 20, thereby opening the fan structure 15. Some embodiments of the disclosed technology may comprise a second flat-sided cover 75 attached to the bottom side of the spring opposite the first flat-sided cover 70. This second flat-sided cover 75 may be positioned at an angle with relation to the first flat-sided cover. When compressible spring 20 is compressed, the second flat-sided cover may act as a barrier between the compressible spring 20 and the toilet 40.

Figure 6:
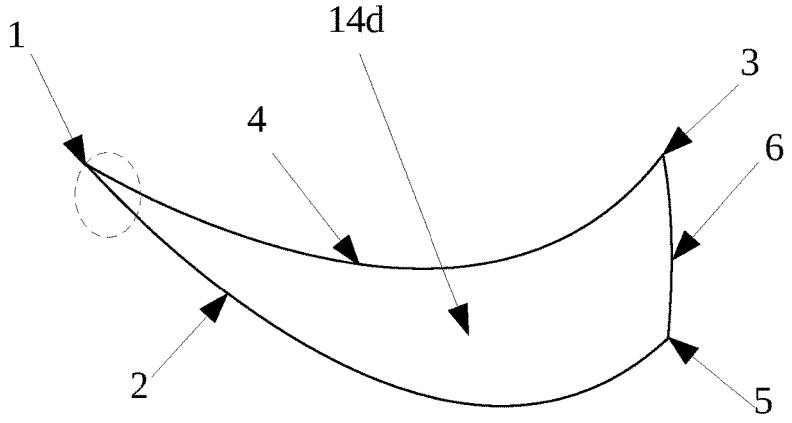
FIG. 6 is a plan view of a blade of the fan structure in an embodiment of the disclosed technology.

Turning to the shape and orientation of each fan blade, FIG. 6 is a plan view of a blade 14*d* of the toilet aerosol device in an embodiment of the disclosed technology. Each blade has three curvilinear edges (2, 4, and 6), the first thereof 6 comprising two end points 3 and 5, one of which is the point of confluence 5 with the second curvilinear edge 2, the other of which is the point of confluence 3 with the third curvilinear edge 4. Furthermore, the second 2 and third 4 curvilinear edge of each blade has a point of confluence 1 opposite the first curvilinear edge 6. Thus, the second 2 and third 4 curvilinear edges span the distance from one point of confluence 1 to a first endpoint 5 and second endpoint 3 of the first curvilinear edge 6 respectively. Described differently, the shape of each fan blade is, in some embodiments, non-polygonal and three-sided. The shape comprises three vertices (1, 3, and 5), each vertex being connected to the other two said vertices by a curved edge. The point of confluence 1 of the second 2 and third 4 curvilinear edges of each blade (herein also referred to as the "apex" of each blade) is attached to the compressible spring 20, such that the point of attachment of each apex of each blade to the compressible spring 20 is located along a same vertical extent of the compressible spring 20. Note that the term "apex" is inclusive of both the exact point of confluence of the second curvilinear edge 2 and the third curvilinear edge 4 as well as the closest subarea of the blade to the exact point of confluence, said subarea comprising up to 10 percent of the total area of the blade (see dotted lines near 1, and region therein in FIG. 6). Note that while the described blade is 14*d*, the number of curvilinear edges and vertices thereof may be common to every blade of the device. Thus, FIG. 6 is not limiting to blade 14*d*, but rather exemplary of a general structure common to every blade 12, 14*a*-14*f*, and 16.

The blades of the fan structure 15 comprise three separate categories of blades: a first end blade 12, a second end blade 16, and central blades 14*a*-14*f* (see FIG. 2 and FIG. 1A). Turning to the central blades 14*a*-14*f*, each blade thereof, when the fan structure is in a resting configuration, abuts two adjacent blades, such that the entirety of the second curvilinear edge 2 of each blade abuts an entirety of the third curvilinear edge 4 of an adjacent blade. Similarly, the entirety of the third curvilinear edge 4 of each given blade within the group of central blades 14*a*-14*f* abuts along the entirety of the second curvilinear edge 2 of an adjacent blade. With regard to the first end blade 12, an entirety of the second curvilinear edge 2 thereof abuts along an entirety of the third curvilinear edge 4 of an adjacent blade of the central blades 14*a*-14*f*, provided that the fan structure is in a resting configuration. Whilst in said resting configuration, an entirety of the third curvilinear edge 4 of the second end blade 16 abuts along an entirety of the second curvilinear edge 2 of a blade of the central blades 14*a*-14*f*.

Described differently, while the fan structure is in said resting configuration (see FIG. 1A), an entirety of the second curvilinear edge 2 of every blade of the plurality of blades of the fan structure 15, except one, abuts an entirety of the third curvilinear edge of an adjacent blade and an entirety of the third curvilinear edge 4 of every said blade of said plurality of said blades, except one, abuts an entirety of the second curvilinear edge 2 of an adjacent blade. The specific blades that do not abut along both the second 2 and the third curvilinear edge 4 of two adjacent blades respectively are the two end blades 12 and 16.

While the fan structure 15 is in said resting configuration (see FIG. 1A), at least one endpoint of the first curvilinear edge 6 of each blade abuts an endpoint of the first curvilinear edge 6 of an adjacent blade. More specifically, both endpoints 3 and 5 of the first curvilinear edge 6 of each blade from the group of central blades 14*a*-14*f* abut an adjacent endpoint of the first curvilinear edge 6 of an adjacent blade.

The two end blades 12 and 16, however, are oriented such that only one endpoint of the first curvilinear edge 6 thereof abuts an endpoint of a first curvilinear edge 6 of an adjacent blade. The abutment of the endpoints of adjacent curvilinear edges may be such that every first curvilinear edge 6 of the blades of the fan structure 15 comprises curvilinear edge of the entire fan structure 15.

For purposes of this disclosure, the term "substantially" is defined as "between 95% and 100%, inclusive" of the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

The term "and/or" is inclusive of the items which it joins linguistically, and each item by itself.

Definitions

"Attached" is defined as "fastened to one another by way of direct contact with one another or such that a connecting mechanism therebetween connects thereto".

"Attached" and "fixedly connected" are used interchangeably in this disclosure.

"Connecting mechanism" is defined as "an arrangement of parts interconnecting two or more components".

"Compressible" is defined as "comprising the ability to resiliently contract along an axis upon an application of force and substantially return to a previous configuration upon cessation of said force".

"Resiliently" is defined as "being able to be repeatedly compressed at least 100 times with no substantial physical change to a device or physical object".

"Flat-sided" is defined as "comprising at least one substantially planar face".

"Calibrated" is defined as "arranged in a manner in order to enable an intended functionality".

"Expanded condition" is defined as "a configuration, wherein an object is elongated along an axis more so than when a user of said object applies compressional force thereto".

"Inwardly collapsed" is defined as "a configuration, wherein a plurality of components of a structure are closer to one another and assume a lesser area than in other configurations of said structure".

"Switch" is defined as "transition between, either directly or by assuming an intermediary step or configuration or plurality thereof".

"Blade" is defined as "a unitary structure calibrated to rotatably translate about a focus".

"Same vertical extent" is defined as "one two dimensional region of a surface or object, extending perpendicular to a most elongated direction of a blade and/or a perpendicular to an upper surface of a toilet bowl the device is adapted to cover". "Upper and lower" are used with respect to a direction of a toilet attached a floor, "upper" being a direction transverse to the floor towards a ceiling.

"Overlaps" is defined as "abuts a surface such that a portion, and less than an entirety thereof is covered".

"Bistable" is defined as "having two stable states or configurations".

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A toilet aerosol containment device, comprising:

a fan structure attached to a compressible spring;

a flat-sided cover attached to said compressible spring;

said fan structure positioned in a first configuration which is unfurled and calibrated to cover a toilet portal when said compressible spring is in an expanded condition; and said fan structure positioned in a second configuration which is inwardly collapsed and calibrated to fit entirely underneath a toilet seat, thereby exposing said toilet portal, when said compressible spring is in a compressed condition;

wherein compression of said spring causes said fan structure to switch from said first configuration to said second configuration.

2. The toilet aerosol containment device of claim 1, wherein:

said fan structure comprises a plurality of blades, each blade of said plurality of blades thereof being attached to a same vertical extent of said compressible spring.

3. The toilet aerosol containment device of claim 2, wherein:

said fan structure is in a transitory configuration whilst inwardly collapsing from said first configuration to said second configuration;

said fan structure is in said transitory configuration whilst unfurling from said second configuration to said first configuration;

said transitory configuration is such that said fan structure partially covers said toilet portal; and a portion of each blade overlaps at least a portion of an adjacent blade when said fan structure is in said second configuration or said transitory configuration.

4. The toilet aerosol containment device of claim 2, wherein:

each said blade has a first curvilinear edge, each endpoint of said first curvilinear edge also being an endpoint of either a second or third curvilinear edge;

said second and third curvilinear edges meet at an apex of said shape, said apex being opposite said first curvilinear edge; and said apex of each said blade is fixedly connected to said compressible spring.

5. The toilet aerosol containment device of claim 4, wherein when said toilet aerosol containment device is in said first configuration:

an entirety of said second curvilinear edge of every said blade of said plurality of said blades, except one, abuts an entirety of said third curvilinear edge of an adjacent blade and an entirety of said third curvilinear edge of every said blade of said plurality of said blades, except one, abuts an entirety of said second curvilinear edge of an adjacent blade; and at least one said endpoint of said first curvilinear edge of each said blade abuts a said endpoint of said first curvilinear edge of an adjacent blade, such that every first curvilinear edge of said blades of said toilet aerosol containment device forms part of a contiguous curvilinear edge of said fan structure.

6. The toilet aerosol containment device of claim 1, wherein:

a face of said flat-sided cover opposite a face of said flat-sided cover attached to said compressible spring is attached to a bottom side of a toilet seat.

7. The toilet aerosol containment device of claim 6, wherein:

a compressional force applied downwards onto a part of said toilet seat when said toilet seat is in a typical position for usage, said part being intended for a user of said toilet seat to sit on, compresses said compressible spring into said compressed condition between said flat-sided cover and a toilet body; and a cessation of said compressional force results in said compressible spring reverting to said expanded condition.

8. A method of installing a toilet aerosol containment device, comprising steps of:

attaching a face of a flat-sided cover to a compressible spring, said spring being bistable between an expanded configuration and a compressed configuration;

attaching a fan structure to said compressible spring, such that said fan structure is in a first configuration, which is unfurled and configured to cover a toilet portal, when said spring is in said expanded configuration; and attaching said fan structure to said compressible spring, such that said fan structure assumes a second configuration when said compressible spring is in a compressed condition, said fan structure being inwardly collapsed and calibrated to fit underneath a toilet seat in said second configuration, adapted to expose said toilet portal.

9. The method of installing the toilet aerosol containment device of claim 8, further comprising a step of:

attaching to a same vertical extent of said compressible spring, a plurality of fan blades, said plurality of fan blades forming said fan structure.

10. The method of installing the toilet aerosol containment device of claim 9, further comprising steps of:

attaching said fan structure to said compressible spring, such that said fan structure assumes a transitory configuration whilst inwardly collapsing from said first configuration to said second configuration; and attaching said fan structure to said compressible spring, such that said fan structure assumes said transitory configuration whilst unfurling from said second configuration to said first configuration;

wherein said transitory configuration is such that said fan structure, when installed under said toilet seat, partially covers said toilet portal; and wherein a portion of each blade overlaps at least a portion of an adjacent blade when said fan structure is in said first configuration or said transitory configuration.

11. The method of installing the toilet aerosol containment device of claim 9, wherein:

each said blade has a first curvilinear edge, each endpoint of said first curvilinear edge also being an endpoint of either a second or third curvilinear edge;

said second and third curvilinear edges meet at an apex of each said blade, said apex being opposite said first curvilinear edge; and each said apex of each said blade is fixedly connected to said compressible spring.

12. The method of installing the toilet aerosol containment device of claim 11, further comprising a step of positioning each said blade such that:

an entirety of said second curvilinear edge of each said blade of said plurality of said blades, except one, abuts an entirety of said third curvilinear edge of an adjacent blade and an entirety of said third curvilinear edge of every said blade of said plurality of said blades, except one, abuts an entirety of said second curvilinear edge of an adjacent blade; and at least one said endpoint of said first curvilinear edge of each blade abuts a said endpoint of said first curvilinear edge of an adjacent blade, such that every first curvilinear edge of said blades of said toilet aerosol containment device forms part of a contiguous curvilinear edge of said fan structure.

13. The method of installing the toilet aerosol containment device of claim 8, further comprising a step of:

attaching to a bottom side of a toilet seat a face of said flat-sided cover opposite a face of said flat-sided cover attached to said compressible spring.

14. The method of installing the toilet aerosol containment device of claim 13, further comprising steps of:

securing said compressible spring to said flat-sided cover and a toilet body, such that said compressible spring assumes said compressed condition, being compressed between said flat-sided cover and said toilet body, when a compressional force is applied downwards onto a part of said toilet seat when said toilet seat is in a typical position for usage, said part being intended for a user of said toilet seat to sit on; and securing said compressible spring to said flat-sided cover and said toilet body, such that a cessation of said compressional force results in said compressible spring reverting to said expanded condition.

15. A toilet aerosol containment device comprising:

a toilet body;

a toilet portal within said toilet body;

a toilet seat hingedly connected to said toilet body;

a compressible spring extending between said toilet seat and said toilet body; and a fan structure substantially perpendicularly attached to said compressible spring, said fan structure comprising a resting configuration, wherein said fan structure is unfurled and covers said toilet portal;

wherein, compression of said spring, caused by pressure applied to said toilet seat towards said toilet body, causes said fan structure to assume an activated configuration, wherein said fan structure is retracted underneath said toilet seat and said toilet portal is exposed; and wherein upon removal of said pressure on said toilet seat, said compressible spring resiliently expands and said fan structure re-covers said toilet portal.

16. The toilet aerosol containment device of claim 15, wherein:

said fan structure comprises a plurality of blades, each blade of said plurality of blades thereof being attached to a same vertical extent of said compressible spring.

17. The toilet aerosol containment device of claim 16, wherein:

said fan structure is in a transitory configuration whilst inwardly collapsing from said resting configuration to said activated configuration;

said fan structure is in said transitory configuration whilst unfurling from said activated configuration to said resting configuration;

said transitory configuration is such that said fan structure partially covers said toilet portal; and a portion of each blade overlaps at least a portion of an adjacent blade when said fan structure is in said activated configuration or said transitory configuration.

18. The toilet aerosol containment device of claim 16, wherein:

each said blade has a first curvilinear edge, each endpoint of said first curvilinear edge also being an endpoint of either a second or third curvilinear edge;

said second and third curvilinear edges meet at an apex of said shape, said apex being opposite said first curvilinear edge; and said apex of each said blade is fixedly connected to said compressible spring.

19. The toilet aerosol containment device of claim 18, wherein when said toilet aerosol containment device is in said resting configuration:

an entirety of said second curvilinear edge of every said blade of said plurality of said blades, except one, abuts an entirety of said third curvilinear edge of an adjacent blade and an entirety of said third curvilinear edge of every said blade of said plurality of said blades, except one, abuts an entirety of said second curvilinear edge of an adjacent blade; and at least one said endpoint of said first curvilinear edge of each blade abuts a said endpoint of said first curvilinear edge of an adjacent blade, such that every first curvilinear edge of said blades of said toilet aerosol containment device forms a contiguous curvilinear edge, said contiguous curvilinear edge comprising part of a continuous ellipsoid circumference of said fan structure.

* * * * *